US006460333B2

(12) United States Patent
Endsley et al.

(10) Patent No.: US 6,460,333 B2
(45) Date of Patent: Oct. 8, 2002

(54) HYDRAULIC PRESSURE TRANSFORMER

(75) Inventors: John C. Endsley, Washington; Frank J. Raab; David C. Hale, both of Chillicothe, all of IL (US)

(73) Assignee: Caterpillar Inc., Peoria, IL (US)

( * ) Notice: Subject to any disclaimer, the term of this patent is extended or adjusted under 35 U.S.C. 154(b) by 65 days.

(21) Appl. No.: 09/747,869

(22) Filed: Dec. 22, 2000

(65) Prior Publication Data

US 2002/0078686 A1 Jun. 27, 2002

(51) Int. Cl.[7] ..... F16D 31/02
(52) U.S. Cl. ..... 60/419; 92/122
(58) Field of Search ..... 60/419; 91/500, 91/503; 92/121, 122; 417/225, 348

(56) References Cited

U.S. PATENT DOCUMENTS 6,092,455 A * 7/2000 Endsley et al. ..... 92/71
6,116,138 A * 9/2000 Achten ..... 60/419

FOREIGN PATENT DOCUMENTS

| | | |
|---|---|---|
| DE | 24 48 469 A | 4/1976 |
| WO | WO 97/31185 | 8/1997 |
| WO | WO 99 40318 A | 8/1999 |

* cited by examiner

*Primary Examiner*—Edward K. Look
*Assistant Examiner*—Michael Leslie
(74) *Attorney, Agent, or Firm*—Todd Taylor

(57) ABSTRACT

A hydraulic pressure transformer has a port block which is attached to an end cap. The end cap includes a plurality of ports opening at an end face and at least one actuation port opening at or near a peripheral surface. A barrel which is rotatable about an axis includes a second end face and a plurality of cylinders having respective cylinder ports which open at the second end face. A port block disposed between the first end face and the second end face is rotatable about an axis and has a first face surface, a second face surface and a plurality of ports extending between the first face surface and the second face surface. The port block includes a radial periphery and at least one vane extending radially outward from the radial periphery to a position adjacent the peripheral surface of the opening.

19 Claims, 3 Drawing Sheets

HYDRAULIC PRESSURE TRANSFORMER

TECHNICAL FIELD

The present invention relates to hydraulic pressure transformers, and, more particularly, to hydraulic pressure transformers having a movable port block interposed between an end cap and a rotating barrel.

BACKGROUND ART

Hydraulic pressure transformers are used to transform an input flow of hydraulic fluid at a first flow rate and pressure to an output flow of hydraulic fluid at a second flow rate and pressure. The output flow rate and pressure-are variable to provide a variable output flow and/or variable output pressure to a specific application, such as a cylinder or motor.

Hydraulic pressure transformers may include a housing with a rotatable barrel and a movable port plate disposed therein. The port plate includes three arcuate slots which selectively interconnect a plurality of ports in the housing with a plurality of cylinders in the barrel upon rotation of the barrel during use. The relative position between the slots in the port plate and the ports in the housing define the output pressure from the hydraulic pressure transformer. An example of this type of a hydraulic pressure transformer is disclosed in PCT International Application No. PCT/NL97/00084, published Aug. 28, 1997.

It is also known to provide a hydraulic pressure transformer with a port block instead of a port plate between the housing and barrel. The port block includes a spherical surface on each end thereof which abuts a complimentary spherical surface on the housing and barrel, respectively. The spherical surfaces at each end of the port block allow slight tipping or tilting between the housing, port block and barrel, while at the same time maintaining a substantially sealed relationship therebetween.

A port block as described above is typically rotatably carried within the housing by a pair of large diameter roller bearings which are seated within the housing and radially surround a port block. Both the housing and the port block are usually formed with stepped annular surfaces which are used to properly seat the roller bearing assemblies relative to each of the housing and the port block. The port block includes an annular flange positioned between the stepped annular surfaces which has teeth on the radial periphery thereof. A pinion gear is rotatably carried by the housing and includes teeth which enmesh with the teeth on the annular shoulder of the port block. Rotation of the pinion shaft using a suitable drive in turn effects the proper positioning of the port block within the housing. The pinion shaft, enmeshing gears, roller bearing assemblies, and stepped annular shoulders which are formed to receive the bearing assemblies, increase the manufacturing complexity and cost of the hydraulic pressure transformer. Additionally, the pinion shaft and associated external drive source increase the size of the hydraulic pressure transformer.

The present invention is directed to overcoming one or more of the problems as set forth above.

DISCLOSURE OF THE INVENTION

In one aspect of the invention, a hydraulic pressure transformer for the conversion of an input hydraulic power to an output hydraulic power comprises an end cap with an opening having a peripheral surface and a first end face. The end cap further includes a plurality of ports opening at the end face and at least one actuation port. A barrel which is rotatable about an axis includes a second end face and a plurality of cylinders having respective cylinder ports which open at the second end face. A port block is disposed within the end cap opening between the first end face of the end cap and the second end face of the barrel. The port block is rotatable about an axis and has a first face surface, a second face surface and a plurality of ports extending between the first face surface and the second face surface. The ports selectively fluidly interconnect the plurality of cylinder ports in the barrel with the plurality of ports in the end cap. The port block includes a radial periphery defining a generally annular channel with the peripheral surface of the opening. The annular channel is disposed in communication with each actuation port. The port block further includes at least one vane extending radially outward from the radial periphery to a position adjacent the peripheral surface of the opening.

In another aspect of the invention, a hydraulic pressure transformer for the conversion of an input hydraulic power to an output hydraulic power comprises an end cap with an opening having a peripheral surface and a first end face. The end cap includes two barrier walls extending radially inward from the peripheral surface. The end cap further includes a plurality of ports opening at the end face and two pairs of actuation ports opening at the peripheral surface. Each pair of actuation ports is disposed adjacent and on opposite sides of a corresponding barrier wall. A barrel which is rotatable about an axis includes a second end face and a plurality of cylinders having respective cylinder ports which open at the second end face. A port block is disposed within the end cap opening between the first end face of the end cap and the second end face of the barrel. The port block is rotatable about an axis and has a first face surface, a second face surface and a plurality of ports extending between the first face surface and the second face surface. The ports selectively fluidly interconnect the plurality of cylinder ports in the barrel with the plurality of ports in the end cap. The port block includes a radial periphery defining a generally annular channel with the peripheral surface of the opening. The port block further includes two vanes extending radially outward from the radial periphery to a position adjacent the peripheral surface of the opening. The vanes are disposed on generally opposite sides of the port block.

BEST MODE FOR CARRYING OUT THE INVENTION

Figure 1:
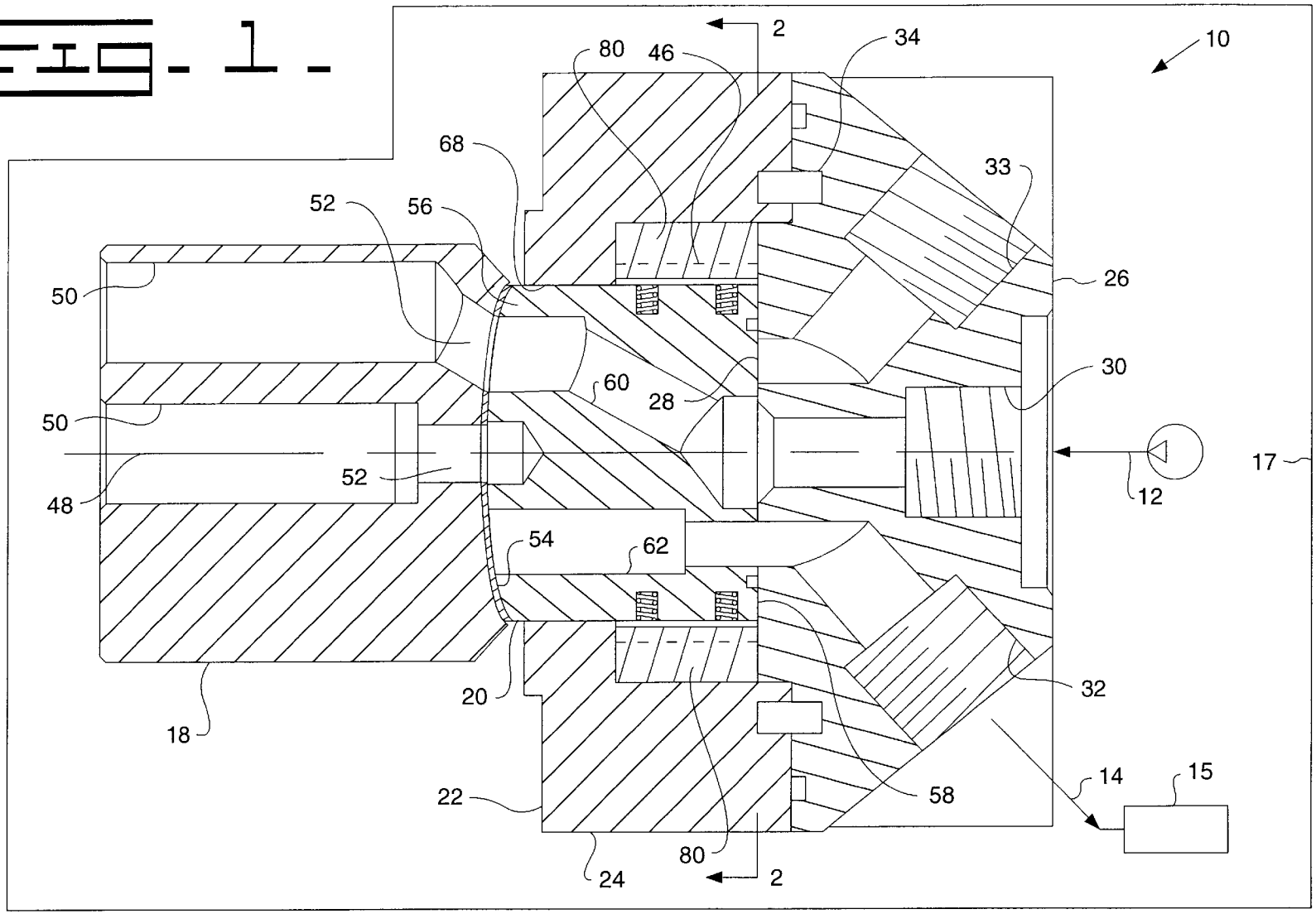
FIG. 1 is a side sectional view of a portion of an embodiment of a hydraulic pressure transformer of the present invention.
Figure 2:
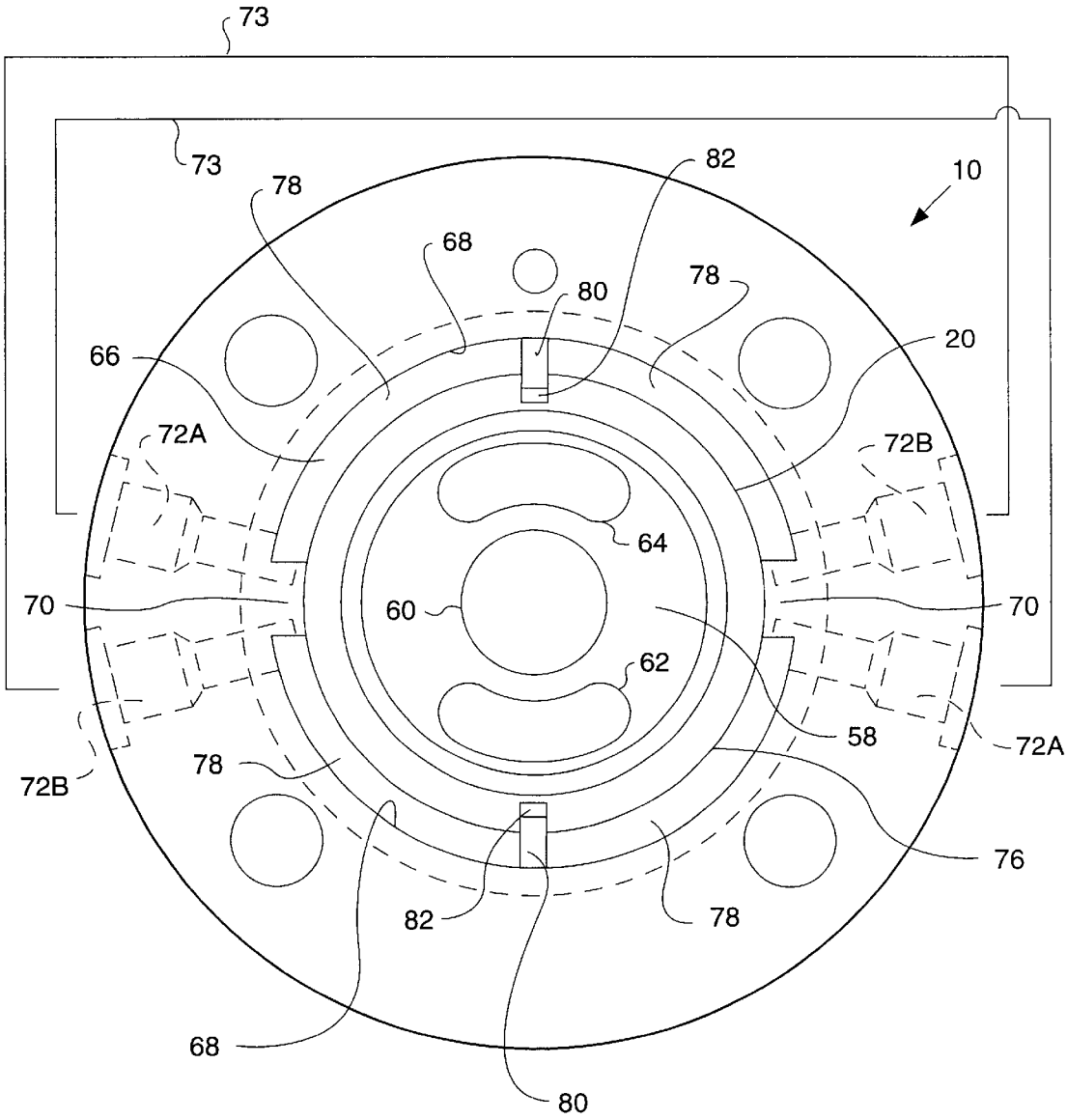
FIG. 2 is a sectional, end view of the hydraulic pressure transformer shown in FIG. 1 taken along line 2—2.

Referring now to the drawings, and more particularly to FIGS. 1 and 2, there is shown an embodiment of a portion of a hydraulic pressure transformer 10 of the present invention for converting an input hydraulic power at a first fluid flow and first fluid pressure (indicated schematically at line 12) to an output hydraulic power at a second fluid flow and second fluid pressure (indicated schematically at line 14). Hydraulic pressure transformer 10 may provide hydraulic output power to a hydraulic work unit 15 (such as a cylinder or a motor) of a work machine 17 (such as a skid steer loader). Hydraulic pressure transformer 10 generally includes a barrel 18, port block 20 and end cap 22.

A two-piece end cap 22 includes a first piece 24 and a second piece 26. The housing 16 could be of any number of pieces without changing the essence of the invention. In the embodiment shown, first piece 24 includes an opening 66 with a peripheral surface 68 and a generally planar end face 28 against which port block 20 abuts. First piece 24 of end cap 22 also includes a plurality of ports 30, 32 and 33 which open at planar end face 28. Port 30, in the embodiment shown, is in the form of an inlet port which receives pressurized hydraulic fluid from a suitable source of pressurized hydraulic fluid 12. Port 32, in the embodiment shown, is in the form of an outlet port providing an outlet flow to a desired application, indicated schematically at 14. First piece 24 of end cap 22 also includes a third port 33 which is fluidly connected with a source of low pressure hydraulic fluid to allow the cylinders within barrel 18 to fill with hydraulic fluid during a portion of the expansion stroke of the pistons carried thereby, in known manner.

End cap 22 includes two barrier walls 70 (FIG. 2) which extend radially inward from peripheral surface 68 within opening 66. End cap 22 also includes four actuation ports 72 which open at peripheral surface 68. The four actuation ports 72 are physically positioned in two pairs of actuation ports, with each pair of actuation ports being disposed adjacent to and on opposite sides of a corresponding barrier wall 70. An actuation port 72 disposed adjacent to a barrier wall 70 is connected in a parallel manner with another actuation port 72 adjacent to the other barrier wall 70, as indicated schematically by lines 73. Thus, the four actuation ports 72 are physically located in two pairs of ports 72, with each actuation port 72 being connected together in a parallel manner with an actuation port 72 in the other pair of actuation ports.

First piece 24 and second piece 26 of end cap 22 are connected together using suitable fastening devices, such as bolts (not shown). A seal 34 provides a substantially fluid-tight seal between first piece 24 and second piece 26.

Barrel 18 is rotatable about an axis 48 and includes a plurality of cylinders 50 with respective cylinder ports 52 which open at a generally spherical end face 54. Barrel 18 also includes a third cylinder (not shown) with a corresponding cylinder port which also opens at spherical end face 54. A plurality of pistons (not shown) are reciprocally disposed within corresponding cylinders 50 in known manner. Spherical end face 54 allows some degree of tilting between barrel 18 and port block 20 as a result of pressure differentials within cylinder ports 52, while at the same time maintaining a substantially fluid-tight seal between barrel 18 and port block 20.

Figure 3:
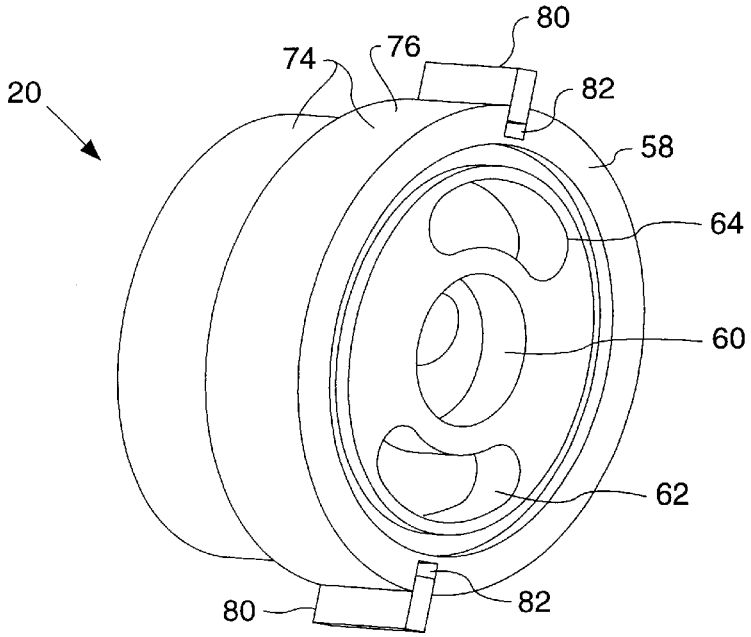
FIG. 3 is a perspective view of the port block shown in FIGS. 1 and 2.
Figure 4:
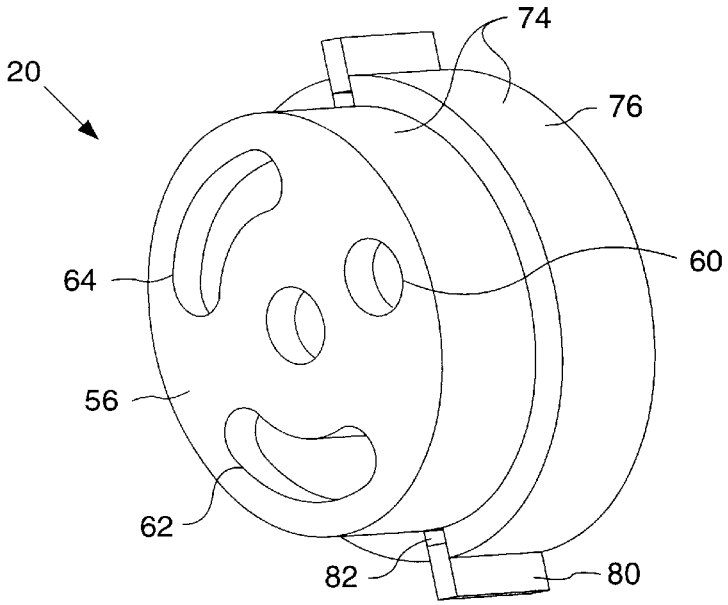
FIG. 4 is another perspective view of the port block shown in FIGS. 1–3.

Port block 20, shown in more detail in FIGS. 3 and 4, is interposed between barrel 18 and end cap 22 and is rotatable about barrel axis 48. Port block 20 includes a first face surface 56, a second face surface 58 and a plurality of ports 60, 62 and 64 which extend between first face surface 56 and second face surface 58. Ports 60, 62 and 64 selectively fluidly interconnect the plurality of cylinder ports 52 in barrel 18 with the plurality of ports 30, 32 and 33 in end cap 22 during rotation of barrel 18.

First face surface 56 is generally spherical and provides a substantially fluid-tight abutment between barrel 18 and port block 20 upon slight tipping between barrel 18 and port block 20 during rotation of barrel 18. Second face surface 58 is a generally flat surface which abuts a corresponding flat end face 28 of end cap 22. By providing second face surface 58 with a generally flat surface, port block 20 may be more easily manufactured and manufacturing costs are reduced. However, second face surface 58 may also be generally spherically shaped.

Port block 20 includes a radial periphery 74 with a flange 76. Flange 46 is disposed adjacent to second face surface 58 and defines a generally annular channel 78 with peripheral surface 68 of opening 66. Annular channel 78 is disposed in communication with each actuation port 72.

Port block 20 also includes two vanes 80 which extend radially outward from flange 76 to a position such that the end of each vane 80 lies adjacent to peripheral surface 68 of opening 66. In the embodiment shown, each vane 80 is disposed on a generally opposite side of radial periphery 74 and is interposed between the adjacent pair of barrier walls 70. Thus, port block 20 can only rotate in a particular rotational direction about axis 48 slightly less than 180°. In the embodiment shown, radial periphery 74 includes two radially inwardly extending slots 82 in which each respective vane 80 is disposed. The clearance distance between slots 82 and vanes 80, as well as the radial clearance distance between vanes 80 and peripheral surface 68 is relatively small such that a fluid such as hydraulic oil within annular channel 78 does not flow past vanes 80 in a substantial manner. Vanes 80 can be attached to radial periphery in other suitable ways, such as by machining port block 20, including vanes 80, from a solid block of material, attaching vanes 80 to radial periphery 74, or molding port block 20 with integral vanes 80.

The angular position of port block 20 relative to ports 30 and 32 is adjusted by transporting pressurized hydraulic fluid through actuation ports 72A and/or 72B within end cap 22. More particularly, pressurized oil flowing through actuation ports 72A causes rotation of port block 20 in a clockwise direction and pressurized fluid flowing through actuation ports 72B causes rotation of port block 20 in a counterclockwise direction. The source of pressurized fluid which is transported through actuation ports 72A and/or 72B can be derived from any suitable source, such as a hydraulic pump with a controllable valve interposed between the pump and actuation ports 72A and 72B.

INDUSTRIAL APPLICABILITY

In use, hydraulic pressure transformer 10 receives pressurized hydraulic fluid at inlet port 30. The pressurized hydraulic fluid is coupled with a cylinder 50 in barrel 18 through port 60 in port block 20, thereby exerting an axial force on the piston located within the cylinder 50 and causing rotation of barrel 18 about axis 48. The angular position of port 60, 62 and 64 in port block 20 relative to the top dead center position is used to adjust an output pressure from outlet port 32. More particularly, pressurized hydraulic fluid is transported through actuation ports 72A or 72B to rotate port block 20 in a clockwise direction or counterclockwise direction, respectively. It may also be possible to apply a controlled back pressure to the other pair of actuation ports 72A or 72B to control the rotational velocity of port block 20 and/or to stop the rotation of port block 20 at a particular location within opening 66.

Hydraulic pressure transformer 10 of the present invention is simpler, less expensive to manufacture and occupies less physical space than conventional designs. By utilizing hydraulic pressure, rather than enmeshing gears, the additional machining steps and associated tolerances, etc. of the enmeshing gears is avoided. Moreover, mechanical wear is reduced thereby reducing down time and replacement parts. By placing the vanes on opposite sides of the port block, a balanced rotational force is exerted on the port block within the housing. The port block need not be carried by expensive bearing assemblies, but rather may be carried by the pressurized hydraulic oil within the annular chamber surrounding the port block. The vanes are carried within slots formed in the port block, and thus are easily attached to the port block and slightly movable to accommodate tolerances within the opening in the housing.

Other aspects, objects and advantages of this invention can be obtained from a study of the drawings, the disclosure and the appended claims.

What is claimed is:

1. A hydraulic pressure transformer for the conversion of an input hydraulic power to an output hydraulic power, said hydraulic pressure transformer comprising:

an end cap including an opening with a peripheral surface and a first end face, said end cap further including a plurality of ports opening at said end face and at least one actuation port;

a barrel rotatable about an axis, said barrel including a second end face and a plurality of cylinders having respective cylinder ports which open at said second end face; and a port block disposed within said end cap opening between said first end face of said end cap and said second end face of said barrel, said port block rotatable about an axis and having a first face surface, a second face surface and a plurality of ports extending between said first face surface and said second face surface, said ports selectively fluidly interconnecting said plurality of cylinder ports in said barrel with said plurality of ports in said end cap, said port block including a radial periphery defining a generally annular channel with said peripheral surface of said opening, said annular channel in communication with each said actuation port, said port block further including at least one vane extending radially outward from said radial periphery to a position adjacent said peripheral surface of said opening.

2. The hydraulic pressure transformer of claim 1, wherein said end cap includes at least one barrier wall extending radially inward from said peripheral surface within said opening to a position adjacent said radial periphery of said port block.

3. The hydraulic pressure transformer of claim 2, wherein said end cap includes a plurality of barrier walls.

4. The hydraulic pressure transformer of claim 3, wherein said end cap includes two barrier walls.

5. The hydraulic pressure transformer of claim 1, wherein said at least one vane has a plurality of vanes.

6. The hydraulic pressure transformer of claim 5, wherein said plurality of vanes has two vanes.

7. The hydraulic pressure transformer of claim 5, wherein said radial periphery of said port block includes a plurality of radially inwardly extending slots, and wherein said plurality of vanes are respectively disposed in said slots.

8. The hydraulic pressure transformer of claim 1, wherein said at least one actuation port has a plurality of actuation ports.

9. The hydraulic pressure transformer of claim 8, wherein said end cap includes at least one barrier wall extending radially inward from said peripheral surface within said opening to a position adjacent said radial periphery of said port block, and wherein said plurality of actuation ports have two actuation ports associated with each said barrier wall.

10. The hydraulic pressure transformer of claim 9, wherein said end cap includes two barrier walls and four actuation ports, and said port block includes two vanes.

11. The hydraulic pressure transformer of claim 10, wherein said two vanes are disposed on generally opposite sides of said radial periphery.

12. The hydraulic pressure transformer of claim 1, wherein said second end face has a generally planar end face.

13. The hydraulic pressure transformer of claim 1, wherein said port block is rotatable about said barrel axis.

14. The hydraulic pressure transformer of claim 1, wherein said radial periphery of said port block includes an annular flange disposed between said first face surface and said second face surface, said vanes extending radially outward from said flange.

15. The hydraulic pressure transformer of claim 1, wherein said end cap is a two-piece end cap.

16. A hydraulic pressure transformer for the conversion of an input hydraulic power to an output hydraulic power, said hydraulic pressure transformer comprising:

an end cap including an opening with a peripheral surface and a first end face, said end cap including two barrier walls extending radially inward from said peripheral surface, said end cap further including a plurality of ports opening at said first end face and two pairs of actuation ports opening at said peripheral surface, each said pair of actuation ports disposed adjacent and on opposite sides of a corresponding said barrier wall;

a barrel rotatable about an axis, said barrel including a second end face and a plurality of cylinders having respective cylinder ports which open at said second end face; and a port block disposed within said end cap opening between said first end face of said end cap and said second end face of said barrel, said port block rotatable about an axis and having a first face surface, a second face surface and a plurality of ports extending between said first face surface and said second face surface, said ports selectively fluidly interconnecting said plurality of cylinder ports in said barrel with said plurality of ports in said end cap, said port block including a radial periphery defining a generally annular channel with said peripheral surface of said opening, said port block further including two vanes extending radially outward from said radial periphery to a position adjacent said peripheral surface of said opening, said vanes disposed on generally opposite sides of said port block.

17. The hydraulic pressure transformer of claim 16, wherein each said actuation port of one of said pairs is connected with another said actuation port of another said pair in a parallel flow manner.

18. A work machine, comprising:

a hydraulic work unit; and a hydraulic pressure transformer including:

an end cap including an opening with a peripheral surface and a first end face, said end cap further including a plurality of ports opening at said end face and at least one actuation port, said plurality of ports including an outlet port in communication with said hydraulic work unit;

a barrel rotatable about an axis, said barrel including a second end face and a plurality of cylinders having respective cylinder ports which open at said second end face; and a port block disposed within said end cap opening between said first end face of said end cap and said second end face of said barrel, said port block rotatable about an axis and having a first face surface, a second face surface and a plurality of ports extending between said first face surface and said second face surface, said ports selectively fluidly interconnecting said plurality of cylinder ports in said barrel with said plurality of ports in said end cap, said port block including a radial periphery defining a generally annular channel with said peripheral surface of said opening, said annular channel in communication with each said actuation port, said port block further including at least one vane extending radially outward from said radial periphery to a position adjacent said peripheral surface of said opening.

19. A method of converting an input hydraulic power to an output hydraulic power using a hydraulic pressure transformer, said method comprising the steps of:

providing an end cap including an opening with a peripheral surface and a first end face, said end cap further including a plurality of ports opening at said end face and at least one actuation port;

providing a barrel rotatable about an axis and including a second end face and a plurality of cylinders having respective cylinder ports which open at said second end face;

providing a port block disposed within said end cap opening between said first end face of said end cap and said second end face of said barrel, said port block having a first face surface, a second face surface and a plurality of ports extending between said first face surface and said second face surface, said port block including a radial periphery defining a generally annular channel with said peripheral surface of said opening, said annular channel in communication with each said actuation port, said port block further including at least one vane extending radially outward from said radial periphery to a position adjacent said peripheral surface of said opening; and rotating said port block about an axis and thereby selectively fluidly interconnecting said ports in said port block between said plurality of cylinder ports in said barrel and said plurality of ports in said end cap.

* * * * *